United States Patent [19]

Webb

[11] 4,262,775

[45] Apr. 21, 1981

[54] OIL SUPPLY MEANS FOR A MACHINE

[75] Inventor: Paul D. Webb, Tioga, Pa.

[73] Assignee: Ingersoll-Rand Company, Woodcliff Lake, N.J.

[21] Appl. No.: 36,606

[22] Filed: May 7, 1979

[51] Int. Cl.[3] ..... F01M 1/16

[52] U.S. Cl. ..... 184/6.4; 137/115; 184/6.16

[58] Field of Search ..... 184/6.4, 6.16, 6 R, 184/6.3; 417/366, 279; 418/203; 137/115

[56] References Cited

U.S. PATENT DOCUMENTS

| | | | |
|---|---|---|---|
| 2,701,684 | 2/1955 | Hirsch | 184/6.16 X |
| 2,871,981 | 2/1959 | Baits | 184/6.4 |
| 3,618,708 | 11/1971 | Deines | 184/6.4 |
| 3,960,245 | 6/1976 | Weinrich | 184/6.16 |
| 4,180,089 | 12/1979 | Webb | 137/115 |

*Primary Examiner*—David H. Brown
*Attorney, Agent, or Firm*—Bernard J. Murphy

[57] ABSTRACT

The invention comprises a subsystem or assembly which lends itself to retro-fitting to a machine to controllingly supply oil to the machine. In the embodiment shown by way of example, the invention supplies injection oil and lubricating oil to an oil-injected and oil-lubricated gas compressor, and includes a pressure-responsive metering device for regulating the relative quantities of injection and lubricating oil supplied pursuant to the operating condition of the compressor. Particularly the invention comprises the use of a small, inexpensive oil pump, to supply substantially only lubrication for the compressor on start-up, and by-passes the pump, when substantially "on line" (i.e., with the compressor discharge pressure elevated), and then supplies less of the oil for lubrication purposes and more for injection (for compressor sealing and cooling).

13 Claims, 1 Drawing Figure

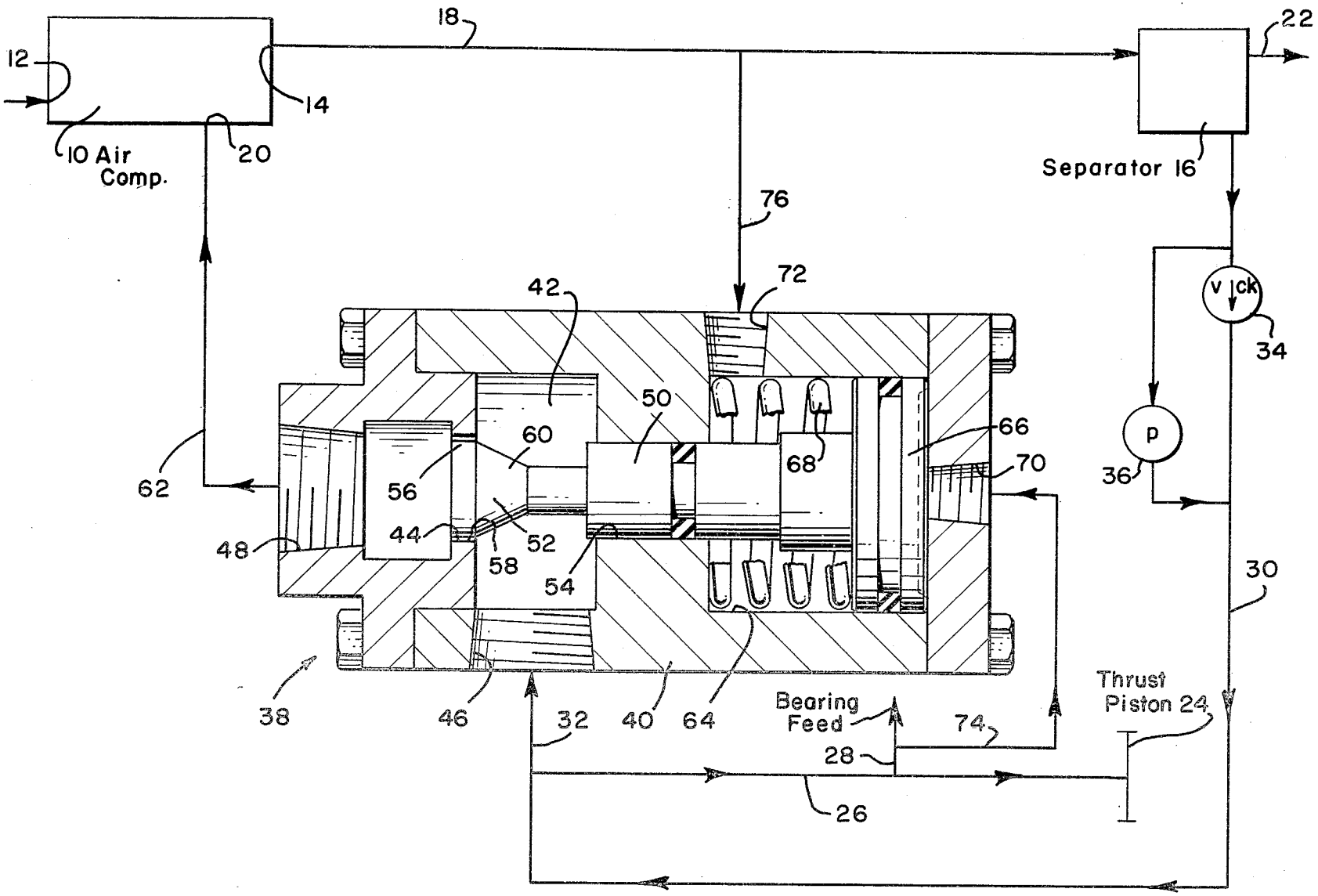
Separator 16
Thrust Piston 24
Bearing Feed
Air Comp.
10
12
14
16
18
20
22
24
26
28
30
32
34
36
38
40
42
44
46
48
50
52
54
56
58
60
62
64
66
68
70
72
74
76

OIL SUPPLY MEANS FOR A MACHINE

This invention pertains to oil supplying subsystems for machines, such as gas compressors, gas expanders, pumps, and the like, and in particular to oil supply means having a special utility with gas compressors that require oil for injection (for sealing or cooling, or both) and for purposes of lubrication, such as oil-injected screw compressors.

Typically, oil-injected screw compressors use large oil pumps for supplying oil for lubrication and injection oil.

Now, an object of this invention is to provide oil supply means that utilizes an oil pump to provide oil pressure for lubrication on start up of the machine with which it is associated, i.e. an oil-injected gas compressor as depicted herein, but then relies on the compressor discharge pressure to maintain oil flow and pressure for lubrication during "on line" running. With this invention the prior art large capacity oil pumps can be replaced with small, typically one gallon per minute, oil pumps for substantially all compressor sizes.

There is in the prior art the teaching of U.S. Pat. No. 3,618,708, issued on Nov. 9, 1971, to Darrel D. Deines for a "Compressor Cooling and Lubricating System." The patentee's System comprises means for bypassing an oil pump therein and supplying oil to an associated gas compressor through the discharge pressure impressed upon a reservoir of oil present in a System receiver-separator. The Deines patented System, however, comprises a large (i.e., standard size) oil pump and, with proper functioning of the System must have such a large pump. Actually, if the Deines System were altered to incorporate a small, one-gallon-per-minute (or the like) oil pump, compressor damage would likely result.

The oil pump supplied with most gas compressor systems is a benefit if it supplies oil to the bearings, and other lubrication areas, immediately on start-up. To supply oil, for instance, to the bearings on start-up, there are provided two flow paths for the oil. One flow path terminates in large compressor rotor chamber injection holes, and the other terminates in small bearing feed holes. With this situation, the unacceptability of a small oil pump in the Deines System becomes clear. One cannot drastically decrease the oil pump size in prior art Systems like that of patentee Deines and still insure a supply of oil to the bearings on start-up since, obviously, the oil will flow through the path of least resistance directly to the rotor chamber, and little or none will go to the bearings.

It is an object of this invention to set forth an improved oil supply means which provides a plurality of oil outputs, for a like plurality of applications in an associated machine, such as an oil-injected and oil-lubricated gas compressor having need for both injection oil and lubricating oil, and variably supplies said outputs in complementary correspondence with the operating parameters of the machine (i.e., gas compressor, for example) with the use of only a single, small oil pump.

It is particularly an object of this invention to set forth an oil supply means, for a machine such as a gas compressor, gas expander, pump, and the like, comprising a reservoir of oil; means defining a source of gas at excursive pressures; and means communicating said reservoir and said source for pressuring said reservoir with said excursive pressures of said source; wherein said reservoir has means defining an oil discharge port; and further including oil conducting means communicating with said port for conducting oil therefrom to a machine; and further including oil shunting means communicating with said oil conducting means for shuntingly diverting oil from said oil conducting means to diminish oil flow via said oil conducting means; means interposed in said oil conducting means for meteringly controlling oil flow therethrough to cause varying quantities of oil to be shuntingly diverted therefrom to said oil shunting means; wherein said controlling means comprises means responsive to attenuating pressures of said reservoir for diminishing oil flow through said oil conducting means, and causing increased oil flow through shunting means, and responsive to elevating pressures in said reservoir to increase oil flow through said oil conducting means and to diminish oil flow through said shunting means.

It is also an object of this invention to disclose an oil supply means, for use in combination with an oil/compressed gas separator, and an oil-injected and oil-lubricated gas compressor which has a discharge port which discharges compressed gas, at excursive pressures, into said separator, comprising a first conduit, for communicating one end thereof with the separator for conducting oil therefrom, and for communicating with the compressor, via the other end thereof, to supply injection oil to the compressor; a second conduit having one end thereof in communication with an intermediate portion of said first conduit, for shuntingly diverting oil from said first conduit, and for communicating with the compressor, via the other end thereof, to supply lubricating oil to the compressor; metering means, interposed in said first conduit, intermediate said second conduit and said other end of said first conduit, operative for meteringly controlling oil flow through said first conduit and causing varying quantities of oil to be shuntingly diverted therefrom to said second conduit; and pressure-responsive operating means, coupled to said metering means, for operating said metering means; wherein said operating means comprises a translatable piston having a pair of opposed, fluid-impingement surfaces; and further including means communicating said second conduit with a first of said surfaces to oil-pressure said surface to urge said piston in a first translating direction; and means for communicating the second of said surfaces with the discharge port of the compressor to gas-pressure said second surface to urge said piston in a second translating direction.

Further objects of this invention, as well as the novel features thereof, will become more apparent by reference to the following description taken in conjunction with the accompanying FIGURE, the latter being a combination line and cross-sectional drawing depicting an embodiment of the novel oil supply means operatively associated with an oil-injected, oil-lubricated gas compressor.

As shown in the FIGURE, an air compressor 10 has an inlet port 12 and a discharge port 14, the latter of which communicates with an air/oil separator 16 by means of a line 18. The air compressor 10, as comprehended by this exemplary embodiment of the novel oil supply means, is an oil-injected and oil-lubricated screw-type, which ingests oil, for cooling and sealing, via a galley or manifold, the general location of which is represented by the index number 20. The separator 16, of course, receives the product compressed air—in which injection oil has been finely diffused—and separates the oil therefrom to allow substantially dry, oil-free compressed air to discharge via line 22. The lower portion of separator 16 defines an oil sump from which injection and lubricating oil is conducted to the compressor 10.

The compressor 10 employs screw-rotor-loading thrust pistons 24, the latter being shown but symbolically, and rotor bearings as well, of course. An oil line 26 supplies oil for fluid-biasing of the pistons 24, and a branch line 28, terminating in an arrow, supplies oil to the bearings for lubrication.

A line 30 supplies oil from the separator 16 to oil line 26, and also to a line 32 which has as its purpose the supply of oil to the injection galley or manifold 20. Line 30 has a check valve 34 interposed therein for two purposes. For one, the valve 34 is provided to prevent a reverse oil flow through line 30 to the separator. In addition, however, valve 34 is provided to open, and bypass the small, one-gallon-per minute pump 36 which is fixed in parallel thereto, when the pressure of the oil in separator 16 (and line 30) is sufficiently elevated. The pump 36 is driven by the compressor 10.

The novel oil supply means incorporate a biased metering device 38 for metering the flow of oil to the galley or manifold 20, and to the bearings—via line 28—and the oil/fluid-biasing of the thrust pistons 24. Device 38 comprises a housing 40 having a dual-area chamber 42 formed therein, the areas thereof being defined by an inwardly-extending annular land 44. A pair of ports 46 and 48 each open onto the chamber 42 for communication therebetween via the chamber. A plunger 50, having a metering head 52 on one end thereof, is slidably and sealingly supported in a housing bore 54. The head 52 has an annular land 56 of smaller diameter than land 44—defining an annular, constricted orifice 58 about land 56, and also has a tapered surface 60 adjacent land 56 for widening the orifice 58 coincident with translation of the plunger 50 in a left-hand direction (as viewed in the FIGURE).

Line 32 supplies oil to port 46 and a first, thereadjacent area of chamber 42, and the oil passes through the orifice 58 into the companion chamber area for discharge via port 48. Then, a line 62 conducts this oil to the galley or manifold 20.

Housing 40 also has a cylinder 64 formed therein which slidably and sealingly receives a piston 66 fixed to the end of plunger 50 which is opposite the head 52. A compression spring 68 biases the piston 66 toward one end of the cylinder 64. A port 70 formed in the housing opens into the cylinder 64 and onto the full-face side of the piston 66. Also, another port 72, formed in the housing 40, opens into the cylinder as well, and onto the opposite side of the piston. An oil tap line 74 communicates branch line 28 with port 70, and a compressed-air tap line 76 communicates discharge line 18 with port 72.

On starting up the compressor 10, the oil pump 36 flows oil immediately to the bearings, and to the thrust pistons 24, and to port 70, to the full area side of the piston 66 and the metering device 38 remains closed until the pump 36 develops sufficient pressure to overcome the spring force. The oil line check valve 34 would be closed at this time, and all of the oil flow would be developed by the oil pump 34. Then, as increasing compressor discharge pressure comes into port 72, to the reduced area side of the piston 66, and into the oil separator 16, the check valve 34 opens, and the discharge pressure in the oil separator 16 maintains and controls the required flow. The small pump 36 is bypassed, having served its function of assuring oil supply to the bearings (and thrust pistons) on start-up.

A small oil pump 36 can be used because on start-up the spring 68 behind the piston 66 has largely closed off the oil injection route (line 32, ports 46, 48, and line 62) to the compressor and substantially all of the oil delivered by the small pump goes directly to the bearings. Then, as the system comes up to pressure, the check valve 34 does by-pass the oil pump and the device 38 distributes the oil as required, to permit the thrust pistons 24 to track the discharge pressures, and to supply sufficient oil to both the bearings and the injection galley or manifold 20. On shutdown the spring 68 again closes off the injection oil and directs the first available oil from the pump 36 to the bearings on the next start.

Lines 32 and 26 effectively define a flow divider for the oil from line 30. Clearly, if the pathway for the oil through line 32, device 38, and line 62 is not constricted, a given quantity or flow of oil will pursue that pathway, and a residual quantity or flow of oil will course through line 26. Alternatively, if the oil pathway through line 32, device 38, and line 62 is constricted, a lesser quantity or flow of oil will pursue that pathway, and a greater quantity or flow of oil will pass through line 26. Accordingly, then, by relatively opening and constricting the aforesaid pathway, oil flows through lines 62 and 26 may be metered. As will be apparent, device 38 provides for such metering in that it has a head 52, with a tapered surface 60, for opening or substantially closing the orifice 58; orifice 58, it can be seen, is interposed between lines 32 and 62.

As noted in the foregoing discussion, a goodly supply of oil is conducted to the bearings (and thrust pistons), via line 26, on starting up the compressor 10. This occurs because, until the compressor generates full discharge pressure, the oil in the sump of separator 16, and line 30, is at low pressure. Accordingly, the low oil pressure in line 30 and line 74 is unable to translate piston 66 against the bias of the spring 68 (and such pneumatic biasing pressure as is admitted into port 72 via line 76). As a result, piston 66 remains as shown (to the right, in the figure), and holds the land 56 of the head 52 in constricting obstruction of orifice 58. Only a considerably limited flow of oil can pass through the orifice 58, from line 32 to line 62. Hence, most of the oil flow from line 30 passes through line 26.

As the compressor proceeds to produce full discharge pressure, concomitantly the oil pressure in the sump of separator 16 and in line 30 increases. As earlier explained, subsequently the check valve 34 opens, and the pump 36 is by-passed. Additionally, the elevating oil pressure proceeds to move the piston 66 to the left, to dispose the reducing diameters of surface 60 within the orifice 58. In this way, the orifice becomes less and less constricted, and: (a) more oil proceeds to flow from line 32 to line 62, and (b) less oil proceeds to flow into line 26. Patently, if the gas pressure in separator 16 attenuates, the sump oil pressure will diminish accordingly—as well as the oil pressure in line 30. Consequently, the diminishing oil pressure in line 74 will allow the piston 66 to proceed to return to the right, and the orifice 58 will become progressively constricted. In this circumstance, the oil flow through the orifice 58 will diminish, and the flow through line 26 will increase.

It is only a matter of predetermining what oil flows are desired, in lines 32 and 26, for given operating conditions, to decide what amount of biasing of piston 66 by spring 68 and pneumatic-pressure tap line 76 shall be employed. Such determinations, then, dictate the choice of spring, the area of the innermost face of piston 66, the area of the outermost face, etc.

Lines 32 and 62 may be considered as the means for conducting a supply of oil to a machine (shown here to be an air compressor 10), and line 26 may be considered as a means for shuntingly diverting oil from lines 32 and 62.

While I have described my invention in connection with a specific embodiment thereof, it is to be clearly understood that this is done only by way of example and not as a limitation to the scope of the invention as set forth in the objects thereof and in the appended claims.

I claim:

1. Oil supply means, for a machine such as a gas compressor, gas expander, pump, and the like, comprising:
- a reservoir of oil;
- means defining a source of gas at excursive pressures;
- means communicating said reservoir and said source for pressuring said reservoir with said excursive pressures of said source;
- oil conducting means communicating with said reservoir for conducting oil therefrom to a machine;
- oil shunting means communicating with said oil conducting means for shuntingly diverting oil from said oil conducting means to diminish oil flow via oil conducting means; and
- means interposed in said oil conducting means for meteringly controlling oil flow therethrough to cause varying quantities of oil to be shuntingly diverted therefrom to said oil shunting means; wherein
- said controlling means comprises means responsive to attenuating pressures of said reservoir for diminishing oil flow through said oil conducting means, and causing increased oil flow through said shunting means, and responsive to elevating pressures in said reservoir to increase oil flow through said oil conducting means and to diminish oil flow through said shunting means.

2. Oil supply means, according to claim 1, wherein:
- said gas source defining means comprises a gas compressor;
- said gas compressor having a gas output port;
- said oil reservoir comprises a gas/oil separator; and
- said oil conducting means comprises a conduit communicating said output port with said oil separator.

3. Oil supply means, according to claim 2, wherein:
- said controlling means comprises a housing having a chamber formed therein having first and second, external, spaced apart ports formed therein which open onto said chamber and metering means movably disposed in said chamber for meteringly controlling fluid flow communication, through said chamber, between said ports;
- said housing further having a cylinder formed therein;
- said metering means comprises a piston, slidably disposed in said cylinder for movement therewithin in first and second directions;
- means within said cylinder engaging a first surface of said piston for biasing said piston in said first direction; and
- means for admitting oil from said shunting means to a second, opposite surface of said piston to urge said piston in said second direction.

4. Oil supply means, according to claim 3, further including:
- means communicating said gas source with said first surface of said piston.

5. Oil supply means, according to claim 1, further including:
- a check valve interposed in said oil conducting means, intermediate said reservoir and said oil-diverting means, for preventing oil flow via said oil conducting means to said reservoir.

6. Oil supply means, according to claim 5, further including:
- a pump through-connected with said oil conducting means, in parallel with said check valve, for impelling oil flow via said oil conducting means.

7. Oil supply means, according to claim 6, wherein:
- said check valve comprises means normally closed to a conduit of oil therethrough, and responsive to a given range of oil pressures for conducting oil therethrough in by-pass of said pump.

8. Oil supply means, for use in combination with an oil/compressed gas separator, and an oil-injected and oil-lubricated gas compressor which has a discharge port which discharges compressed gas, at excursive pressures, into said separator, comprising:
- a first conduit, for communicating one end thereof with the separator for conducting oil therefrom, and for communicating with the compressor, via the other end thereof, to supply injection oil to the compressor;
- a second conduit having one end thereof in communication with an intermediate portion of said first conduit, for shuntingly diverting oil from said first conduit, and for communicating with the compressor, via the other end thereof, to supply lubricating oil to the compressor;
- metering means, interposed in said first conduit, intermediate said second conduit and said other end of said first conduit, operative for meteringly controlling oil flow through said first conduit and causing varying quantities of oil to be shuntingly diverted therefrom to said second conduit; and
- pressure-responsive operating means, coupled to said metering means, for operating said metering means; wherein
- said operating means comprises a translatable piston having a pair of opposed, fluid-impingement surfaces; and further including
- means communicating said second conduit with a first of said surfaces to oil-pressure said surface to urge said piston in a first translating direction; and
- means for communicating the second of said surfaces with the discharge port of the compressor to gas-pressure said second surface to urge said piston in a second translating direction.

9. Oil supply means, according to claim 8, further including:
- means normally urging said piston in said second direction.

10. Oil supply means, according to claim 8, further including:
- biasing means, engaged with said second surface of said piston, normally urging said piston in said second direction.

11. Oil supply means, according to claim 10, further including:
- an oil pump, interposed in said first conduit, intermediate said second conduit and said one end of said first conduit, for impelling oil through said first conduit.

12. Oil supply means, according to claim 11, further including:

means interposed in said first conduit, in parallel with said oil pump, normally closed to a conduit of oil therethrough, and responsive to a given range of oil pressures for conducting oil therethrough to by-pass said pump.

13. Oil supply means, according to claim 12, wherein: said normally-closed, first-conduit interposed means comprises a check valve for preventing oil flow through said first conduit toward said one end of said conduit.

* * * * *